US006361384B1

(12) United States Patent
Manor et al.

(10) Patent No.: US 6,361,384 B1
(45) Date of Patent: Mar. 26, 2002

(54) EYELET TERMINAL WITH CAPTIVE BOLT

(75) Inventors: Michael Anthony Manor, Riverview; Kazuhiro Shimizu, West Bloomfield; Takeshi Takahashi, Novi, all of MI (US)

(73) Assignee: Yazaki North America

( * ) Notice: Subject to any disclaimer, the term of this patent is extended or adjusted under 35 U.S.C. 154(b) by 0 days.

(21) Appl. No.: 09/540,965

(22) Filed: Mar. 31, 2000

(51) Int. Cl.[7] ..... H01R 11/11
(52) U.S. Cl. ..... 439/883; 439/567; 439/557
(58) Field of Search ..... 439/883, 927, 439/567, 557, 558, 92, 801

(56) References Cited

U.S. PATENT DOCUMENTS

| | | | | |
|---|---|---|---|---|
| 4,061,412 A | * | 12/1977 | Skinner | 339/263 R |
| 4,832,629 A | | 5/1989 | Sasaki | |
| 4,950,186 A | * | 8/1990 | Kaley et al. | 439/892 |
| 5,203,716 A | * | 4/1993 | Martucci et al. | 439/411 |
| 5,426,831 A | | 6/1995 | Leonelli | |
| 5,588,883 A | | 12/1996 | Hattori | |
| 5,759,055 A | * | 6/1998 | Colantuano et al. | 439/287 |
| 5,772,453 A | * | 6/1998 | Tan et al. | 439/79 |
| 5,863,227 A | | 1/1999 | Bell | |
| 5,885,116 A | | 3/1999 | Byfield | |
| 5,897,403 A | | 4/1999 | Kourmimsky | |
| 6,080,012 A | * | 6/2000 | Zhu et al. | 439/567 |

FOREIGN PATENT DOCUMENTS

JP 62-200246 12/1987

* cited by examiner

*Primary Examiner*—Karl D. Easthom
*Assistant Examiner*—Kyung S. Lee
(74) *Attorney, Agent, or Firm*—Young & Basile

(57) ABSTRACT

An eyelet terminal for holding a bolt in a pre-set position relative to a mounting member wherein the threaded portion of the bolt is proximate a female threaded portion of the mounting member. In this pre-set position, the bolt is on the verge of engagement with the female threaded portion so that rotation of the bolt causes it to immediately begin to engage the female threaded portion. The terminal has two generally circular eyelets connected with one another by a spacing member which maintains the two eyelets in a spaced apart and generally parallel relationship. The first eyelet has a plurality of circumferentially spaced tabs projecting radially inward into its aperture to engage a bolt and maintain it in rotatable connection with the terminal such that the bolt shank passes through both eyelet apertures. The second eyelet has retainer prongs extending generally perpendicular therefrom. The retainer is inserted into engagement with a first hole in the mounting member so that the second eyelet is adjacent the mounting member and the bolt is aligned with a threaded hole in the mounting member. The first and second eyelets are spaced apart by a distance such that when the bolt is captive in the first eyelet and the retainer is engaged with the mounting member, the bolt is maintained in the pre-set position. As the bolt is driven into engagement with the mounting member, the spacing member deforms to allow the first eyelet to move toward the second eyelet.

17 Claims, 4 Drawing Sheets

EYELET TERMINAL WITH CAPTIVE BOLT

FIELD OF THE INVENTION

The invention relates to electrical eyelet terminals of the type which are bolted to a mounting member in order to provide electrical continuity between a conductor attached to the terminal and the mounting member.

BACKGROUND OF THE INVENTION

Eyelet terminals are used to secure an electrical wire to a mounting member such as a grounding surface or some other component of an electrical circuit. A conventional eyelet terminal is a generally flat, circular piece of electrically conductive metal with a stem to which the wire is crimped, soldered or otherwise permanently secured, and a central aperture for receiving a bolt. The bolt is inserted through the aperture and driven into engagement with a female threaded portion of the mounting member. The bolting operation is typically performed manually and requires the person performing the assembly to control at least three items: the terminal, the bolt, and the tool used to drive the bolt. To reduce the likelihood that the bolt may fall out of connection with the eyelet before it is driven into engagement with the mounting member, it is known to design the eyelet terminal so that it holds the bolt rotatably captive within the aperture. This is commonly achieved by forming small tabs or arms extending radially inward from the inner edge of the aperture to engage an unthreaded portion of the bolt shank immediately below the bolt head. An eyelet terminal with means for holding a bolt captive therein is disclosed in U.S. Pat. No. 5,863,227.

Even with the bolt held captive in the eyelet terminal, fastening the terminal to the mounting member requires the assembler to use two hands: one to hold and position the bolt/terminal combination over the bolt receiving hole in the mounting 25 member, and the other to hold and operate the bolt driving tool. This may be difficult or impossible to achieve if the terminal must be installed in a space-limited area. Even if there is room for a two-handed assembly operation, once the assembler begins to tighten the bolt the eyelet terminal may tend to rotate with respect to the mounting member, causing the wire attached to the terminal to become twisted, improperly routed, or subjected to undesirable tension.

SUMMARY OF THE INVENTION

The invention is an eyelet terminal that captures a bolt and is engageable with a mounting member to pre-position the terminal and bolt prior to the bolt being driven into engagement with the mounting member.

In the illustrative embodiment of the invention disclosed herein, an eyelet terminal has two generally circular eyelets in a spaced apart and generally parallel relationship with respective apertures in coaxial alignment. The first eyelet has a plurality of circumferentially spaced tabs projecting radially inward into its aperture to engage the bolt immediately adjacent the bolt head and retain the bolt in connection with the terminal. The second eyelet has retainer prongs extending toward the mounting member.

The bolt is held captive by the terminal so that the bolt head is adjacent the first eyelet and the shank passes through both eyelet apertures. The retainer is inserted into engagement with a first hole in the mounting member so that the second eyelet is adjacent the mounting member and the bolt is aligned with a second hole in the mounting member. This attachment of the terminal to the mounting member may be accomplished using only one hand and results in the bolt being held in a pre-set position from which it may be driven into engagement with female threaded means on the mounting member. As the bolt is driven into engagement with the mounting member, the spacing member deforms as the first eyelet is urged toward the second eyelet.

According to another feature of the invention, the first and second eyelets are spaced apart by a distance such that when the bolt is captive in the first eyelet and the retainer is engaged with the mounting member, the bolt is maintained in a pre-set position wherein the distal end of the threaded portion of the bolt shank is proximate a female threaded portion of the mounting member. In this pre-set position, the bolt is on the verge of engagement with the female threaded portion so that rotation of the bolt causes it to immediately begin to engage the female threaded portion.

According to a further feature of the invention, a spacing member comprising a curved section connects the eyelets and has a radius of curvature greater than one half of the distance separating the first and second eyelets. This large radius curve allows the spacing member to deform easily when the first eyelet is urged toward the second eyelet as the bolt is driven into engagement with the mounting member.

According to a further feature of the invention, a first retainer prong is relatively narrow so that it is flexible and a second retainer prong is wider and more rigid. The first prong is flexible so that it can deflect to allow the prongs to be urged through a slot in the mounting member. The second retainer prong is on the proper side of the terminal so that it is urged into contact with the edge of the slot when the terminal tends to rotate as the bolt is tightened, and is strong enough to resist the resulting force without deforming significantly.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
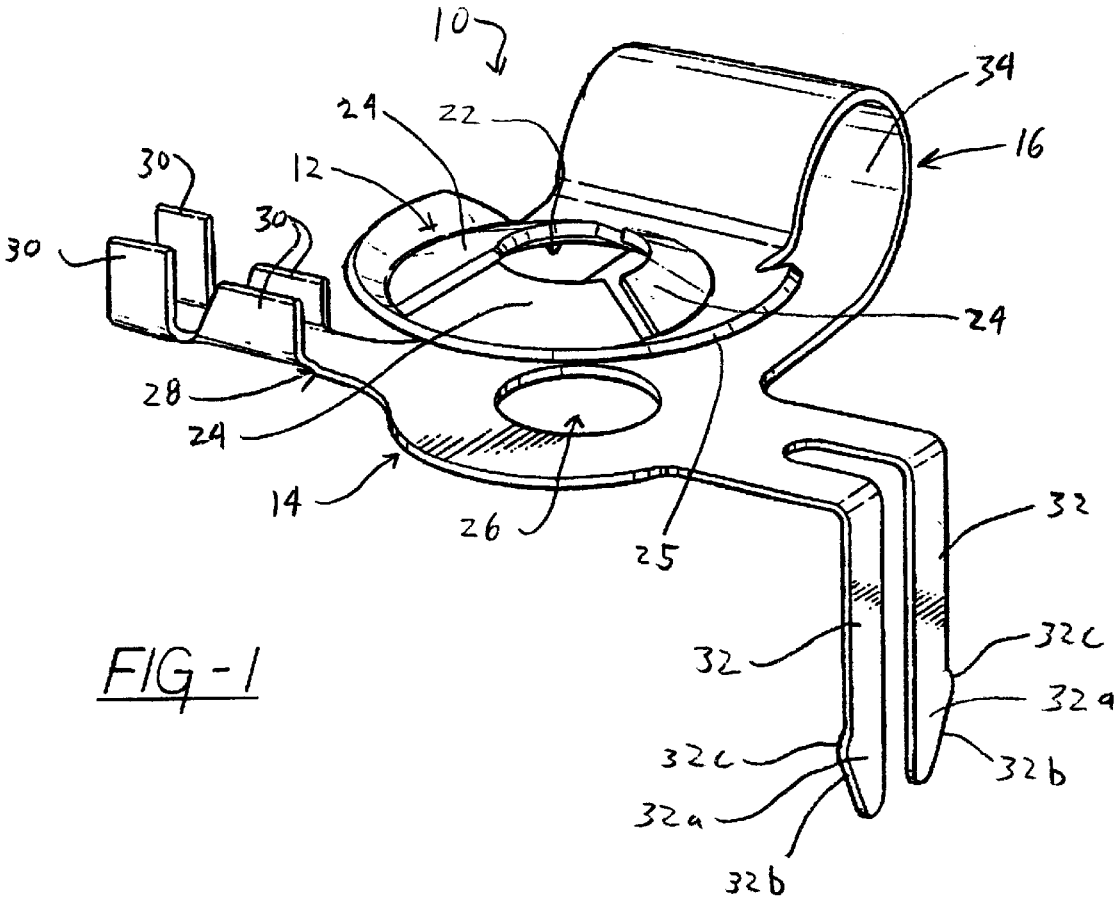
FIG. 1 is a perspective view of a terminal according to the present invention.

As seen in FIGS. 1–7, an eyelet terminal 10 according to the present invention generally comprises first and second generally circular eyelets 12,14 connected by and maintained in a generally parallel, spaced relationship by a curved spacing member 16. An electrical wire 18 is crimped into connection with terminal 10 (see FIGS. 5 and 6) and a bolt 20 passes through the eyelets 12,14 and engages a mounting member 21 to provide electrical continuity between the wire and the mounting member.

First eyelet 12 has a circular central aperture 22. Three slots 23 extend radially outward from the inner edge of aperture 22 to divide the inner portion of eyelet 12 into three tabs 24. Tabs 24 are angled upwardly at a shallow angle to create a truncated cone effect, as best seen in FIG. 1. The outer circumferential edge of first eyelet 12 is also angled upwardly to form a lip 25.

Second eyelet 14 is generally flat and has a circular central aperture 26. A wire connection stem 28 extends radially outward from second eyelet 14 and has crimping tabs 30. A pair of retaining prongs 32 extend outwardly from second eyelet 14 and are bent to extend downwardly approximately perpendicular to the plane of the second eyelet. Prongs 32 are shown extending from second eyelet 14 diametrically opposite from stem 28, but may be disposed at any position on the second eyelet. Each prong 32 has a generally triangular tip 32*a* with an angled outer edge 32*b* and a lobe 32*c* which projects outwardly beyond the main portion of the prong.

Figure 2:
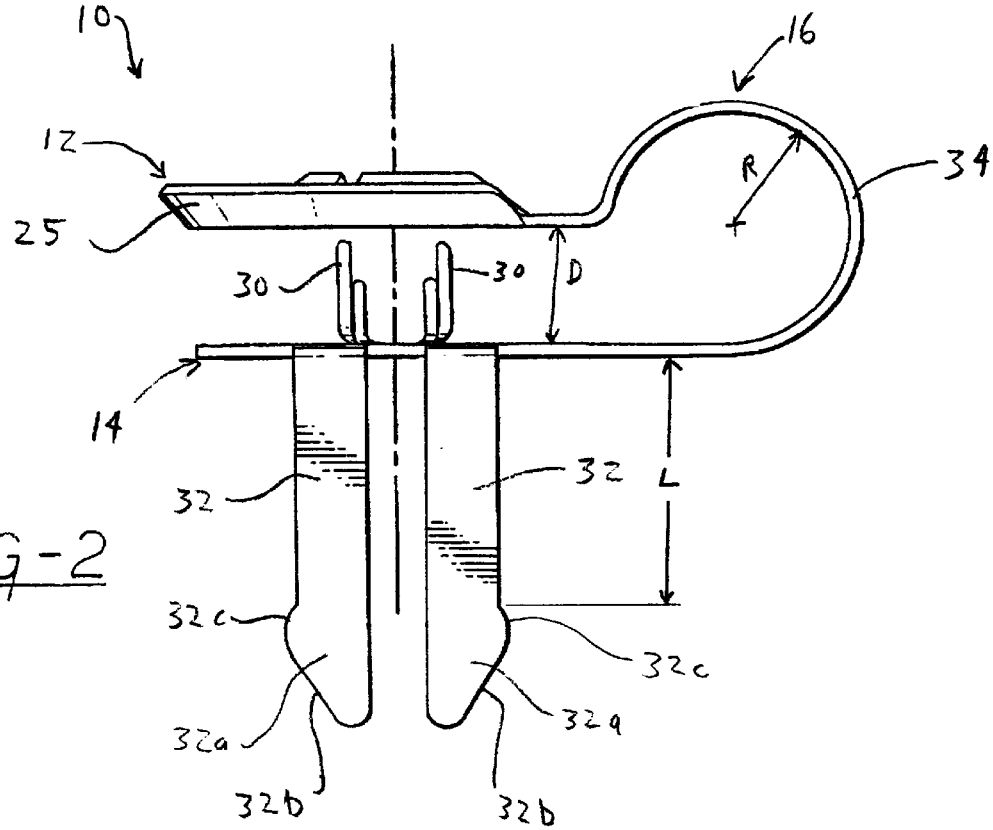
FIG. 2 is a side view of the terminal of FIG. 1.

As best seen in FIG. 2, spacing member 16 has a smooth, generally circular curved section 34 with a radius of curvature R greater than one half of the distance D separating the first and second eyelets 12,14.

Figure 4:
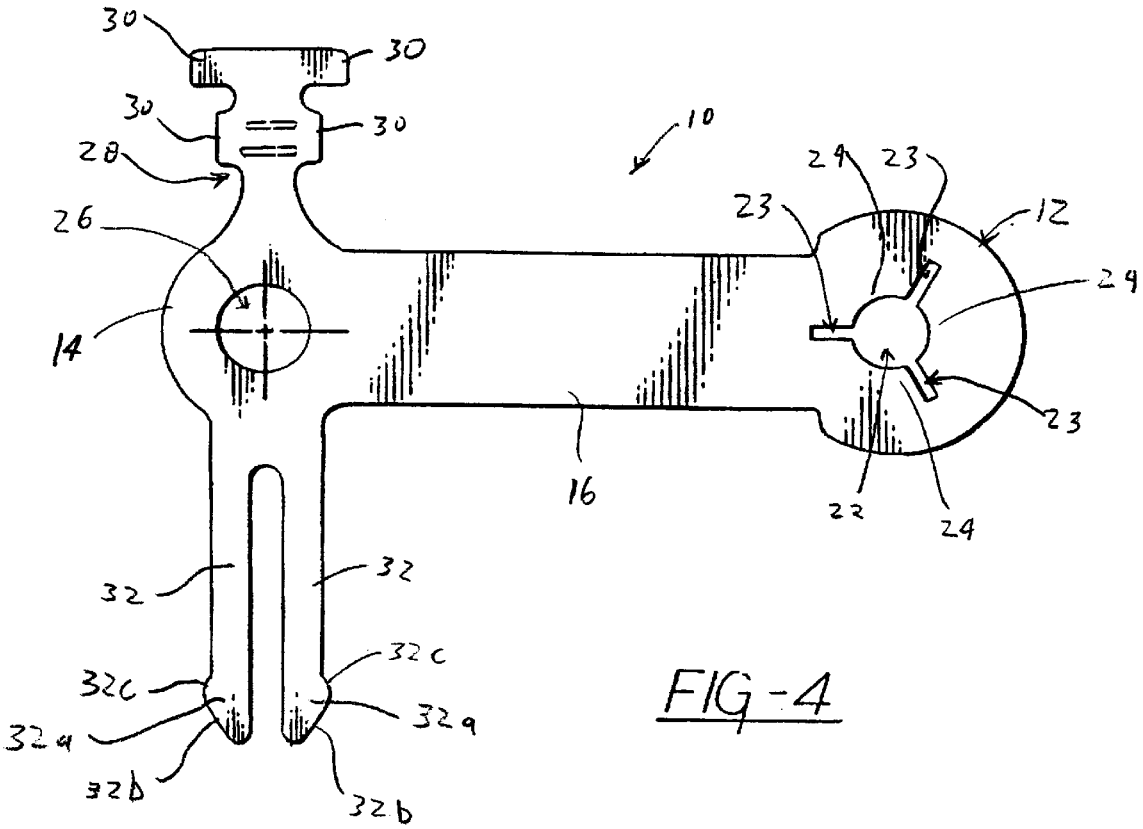
FIG. 4 is a top view of a stamping used to form the terminal of FIGS. 1–3.

Eyelet terminal 10 is preferably formed from a single piece of electrically conductive metal by a stamping and bending process. FIG. 4 depicts the single piece of metal after being stamped but prior to bending.

Figure 5:
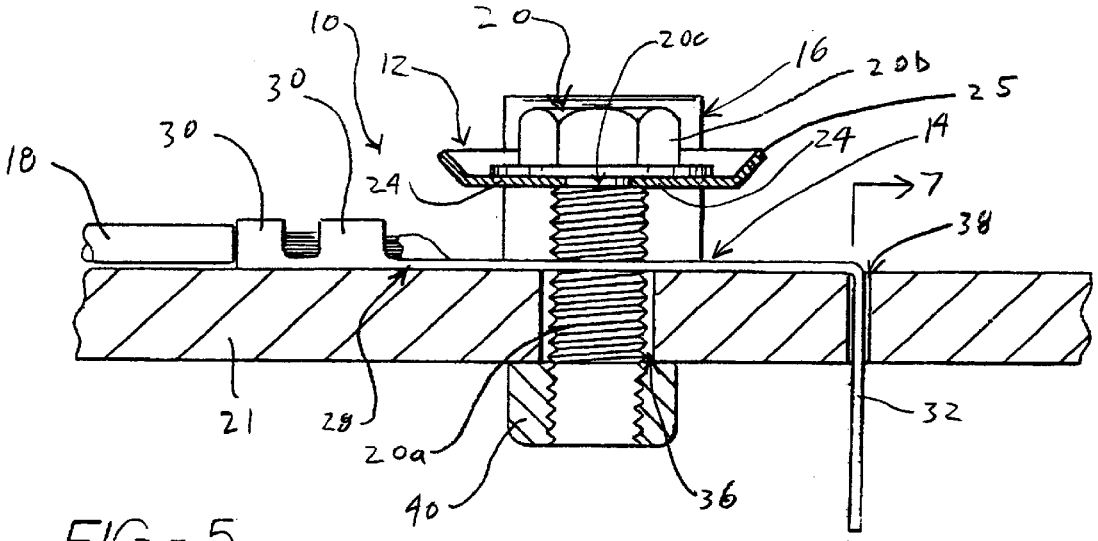
FIG. 5 is a side view of the invention terminal engaged with a mounting member and retaining a bolt in a pre-set position.
Figure 7:
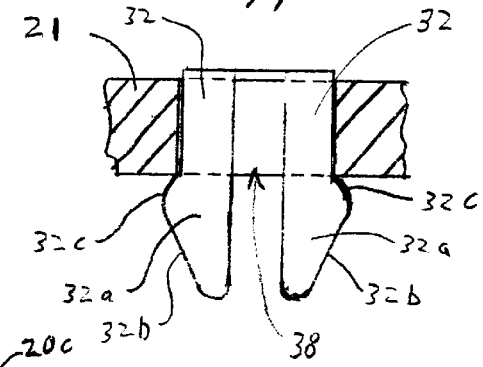
FIG. 7 is a section view taken along line 7—7 of FIG. 5.
Figure 6:
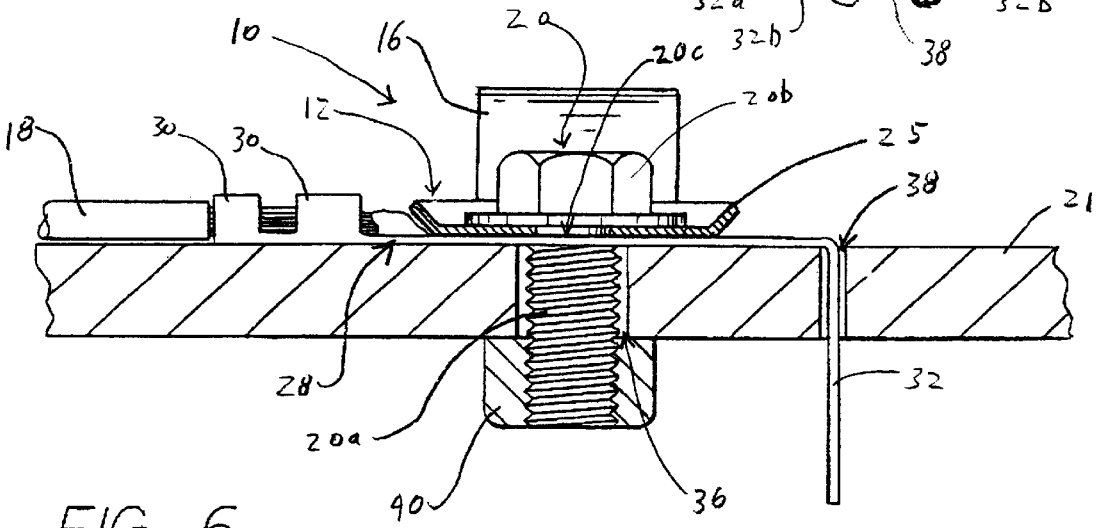
FIG. 6 is a side view similar to FIG. 5 with the bolt driven into full engagement with the mounting member.

As seen in FIGS. 5–7, terminal 10 is used to physically connect and provide electrical continuity between wire 18 and mounting member 21. While the preferred embodiment depicted herein shows wire 18 connected to wire connection stem 28 extending from second eyelet 14, there are many possible alternative means for connecting the wire to terminal 10, and any of these are within the scope of the invention. For example, wire 18 may be soldered directly to the upper surface of second eyelet 14, to the lower surface of first eyelet 12, or to spacing member 16. In a typical use of an eyelet terminal 10 according to the invention, mounting member 21 is part of a metal panel, frame, or chassis and provides an electrical ground for the circuit with which wire 18 connects. A mounting member 21 for use with terminal 10 according to the present invention has two holes formed therethrough: a circular hole 36 and a narrow slot 38. A female threaded nut 40 is welded or otherwise secured to the lower surface of mounting member 21 beneath circular hole 36. Circular hole 36 is sized to allow a threaded shank 20*a* of bolt 20 to pass freely therethrough. Slot 38 is of a width (perpendicular to page in FIGS. 5 and 6) slightly greater than the width of the main portions of prongs 32 but narrower than the distance between the outer edges of lobes 32*c*. Hole 36 and slot 38 are spaced by a distance matching the distance between retainer prongs 32 and the central axis of apertures 22,26.

Figure 3:
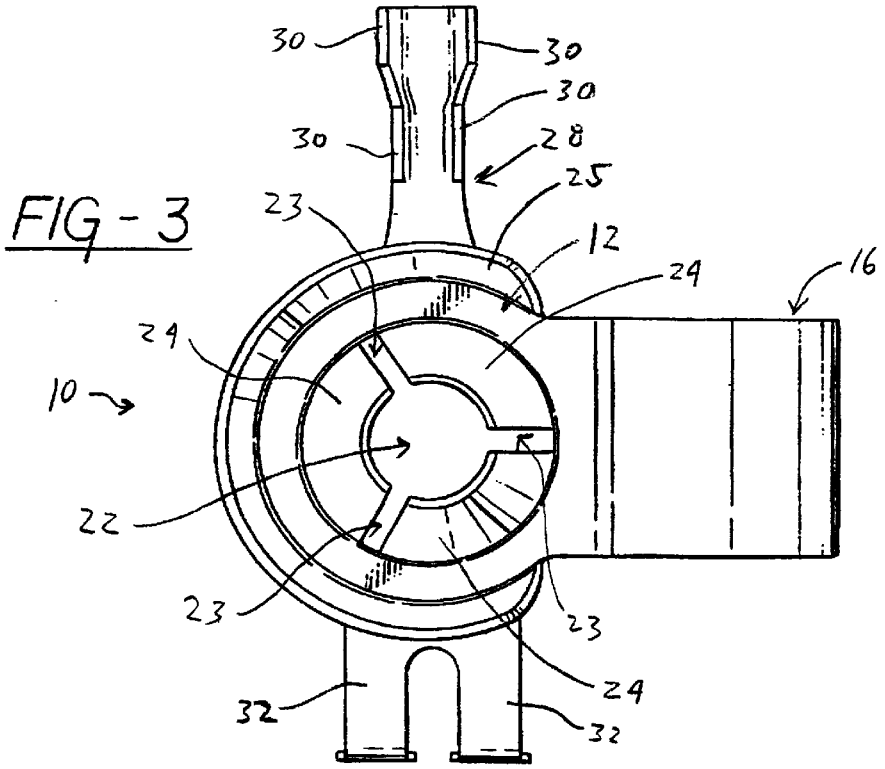
FIG. 3 is a top view of the terminal of FIG. 1.

When tabs 24 are in the upwardly angled configuration shown in FIGS. 1–3, aperture 22 is large enough for threaded shank 20*a* to pass freely therethrough until the bottom of bolt head 20*b* contacts the tabs. When bolt 20 is fully inserted in first eyelet 12, an unthreaded portion 20*c* of the bolt shank immediately below bolt head 20*b* is surround by tabs 24. Tabs 24 are then bent downwardly so they are flat, their inner edges forming a diameter smaller than the outside diameter of the bolt threads, thus holding bolt 20 captive within first eyelet 12 as shown in FIGS. 5 and 6. This may be accomplished by inserting a jig (not shown) between first and second eyelets 12,14 and pressing bolt head 20*b* downwardly to urge tabs 24 against the jig until they are flat.

Terminal 10 is placed in engagement with mounting member 21 by inserting retaining prongs 32 through slot 38 and urging the terminal downwardly until second eyelet 14 is adjacent the upper surface of the mounting member 21. As prongs 32 are inserted downwardly through slot 38, angled outer edges 32*b* of tips 32*a* contact the inner edges of the slot 38 and the prongs 32 deflect slightly inwardly to allow passage of lobes 32*c* therethrough. After tips 32*a* have passed completely through slot 38, prongs 32 spring back outwardly away from one another so that lobes 32*c* hook beneath the lower surface of mounting member 21 (see FIG. 7) to retain the terminal 10 in engagement with the mounting member 21. In FIG. 7, the terminal is shown engaged with the thickest mounting member 21 with which it may be used. That is, the thickness of mounting member 21 is approximately equal to the length L (see FIG. 2) of prongs 32 between second eyelet 14 and lobes 32*c*, so that the second eyelet is held flush against the upper surface of the mounting member. Terminal 10 may also be used with thinner mounting members, in which case second eyelet 14 will not be held flush with the mounting member.

When terminal 10 is engaged with mounting member 21, bolt 20 is maintained in the pre-set position shown in FIG. 5 wherein shank 20*a* projects through hole 36 so that the male threads at the distal end of the shank just contact the female threads of nut 40. The pre-set position is established by adjusting the geometry of terminal 10 such that distance D between the first and second eyelets 12,14 plus length L of prongs 32 plus the thickness of the second eyelet is approximately equal to the distance by which bolt shank 20*a* projects below second eyelet 14 when the bolt is captive in the terminal. In this pre-set position, the bolt is on the verge of engagement with the female threaded portion so that rotation of the bolt causes it to immediately begin to engage the female threaded portion. Accordingly, the terminal does not need to be held in position prior to or as it is being turned, but rather may be driven into engagement with female threaded means on the mounting member in a one-handed operation.

It is also possible for the inner surface of circular hole 36 to be formed with female threads for engaging bolt 20, so that nut 40 may be dispensed with. In this case, the distance D between first and second eyelets 12,14 is adjusted to be approximately equal to the length of threaded shank 20*a*, so that the distal end of the shank projects just barely through second eyelet 14 and rests against the female threads at the opening of hole 36 when terminal 10 is engaged with mounting member 21. In this case, too, the result is that the threads at the end of shank 20*a* just contact the female threaded portion of mounting member 21.

In an alternative connection, bolt 20 is of the self-tapping type and female threaded nut 40 is replaced with an unthreaded nut (not shown). The self-tapping bolt cuts its own threads in the unthreaded nut as it is driven. The use of a self-tapping bolt eliminates the possibility of cross-threading as the bolt is driven, and the bolt will clean out any weld spatter that may have been produced during welding of the nut to mounting member 21.

A bolt driving tool such as a wrench (not shown) is then used to rotate bolt 20 and drive it into threaded engagement with nut 40. As bolt 20 is driven, first eyelet 12 is forced downwardly toward second eyelet 14 until the two contact one another and bolt head 20*b* is surrounded by lip 25 (see FIG. 6). The large radius R of curved section 34 relative to the distance D between the first and second eyelets 12,14 allows the spacing member to deform easily, offering a minimum amount of resistance to the movement of first eyelet 12 toward second eyelet 14.

Figure 8:
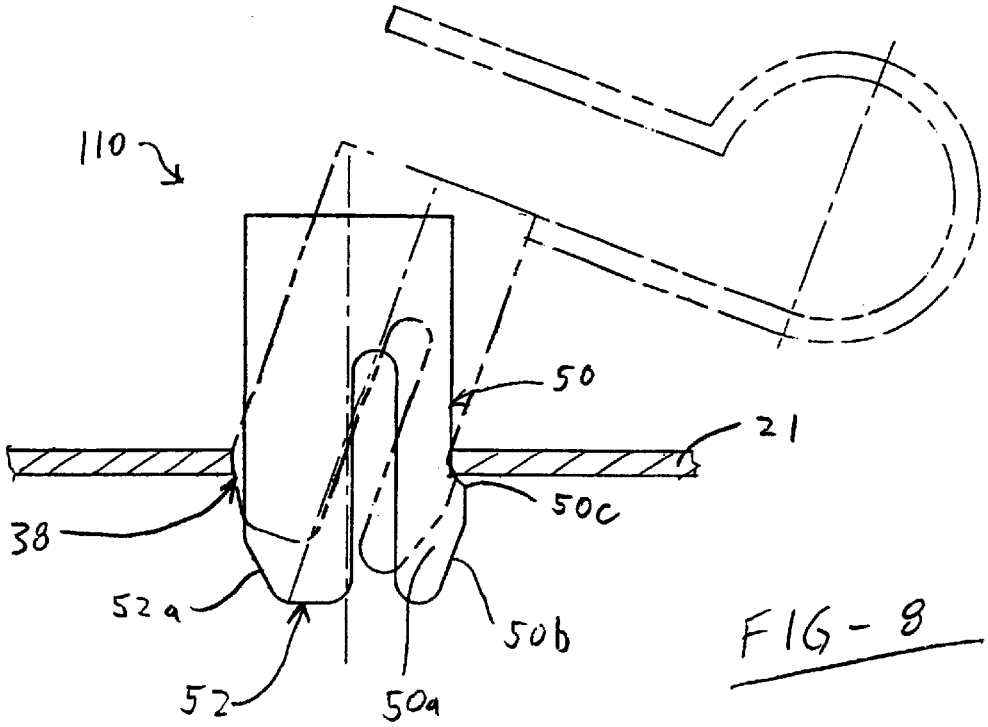
FIG. 8 illustrates a second embodiment of retainer prongs of the terminal.

FIG. 8 depicts a terminal 110 according to the present invention with an alternative design for the retainer prongs. A first prong 50 is generally similar to prongs 32 of the embodiment of FIGS. 1–7, having a generally triangular tip 50*a* with an angled outer edge 50*b* and a lobe 50*c* projecting outwardly beyond the main portion of the prong. A second prong 52 is wider than first prong 50 and has a angled outer edge 52*a* but no outwardly projecting lobe. Terminal 110 may be placed in engagement with mounting member 21 by tipping the terminal toward first prong 50 (as seen in phantom lines in FIG. 8) as the prongs are inserted through slot 38, hooking lobe 50*c* beneath the mounting member and then rocking the terminal back to an upright position to insert second prong 52 through the slot. First prong needs to deflect only slightly to permit second prong 52 to enter slot 38, and angled outer edge 52*a* of the second prong allows it to slide through slot 38 with a minimum of resistance, thereby achieving a very low insertion force. If desired, terminal 110 may also be urged straight downwardly without tipping. In this case first prong 50 must deflect an amount sufficient to allow lobe 50*c* to fit through slot 38, thus requiring greater insertion force than when using the tipping method.

First prong 50 is relatively narrow so that it deflects easily to permit insertion through slot 38 in the manner described above. Second prong 52 is wider because it must prevent the rotation of terminal 110 as it is secured to mounting member 21 with bolt 20. As bolt 20 is driven in a clockwise direction into engagement with nut 40, terminal 110 tends to rotate along with the bolt so that second prong 52 is urged against the left side of slot 38 (as viewed in FIG. 8) and so is subjected to a significant amount of bending force.

Figure 9:
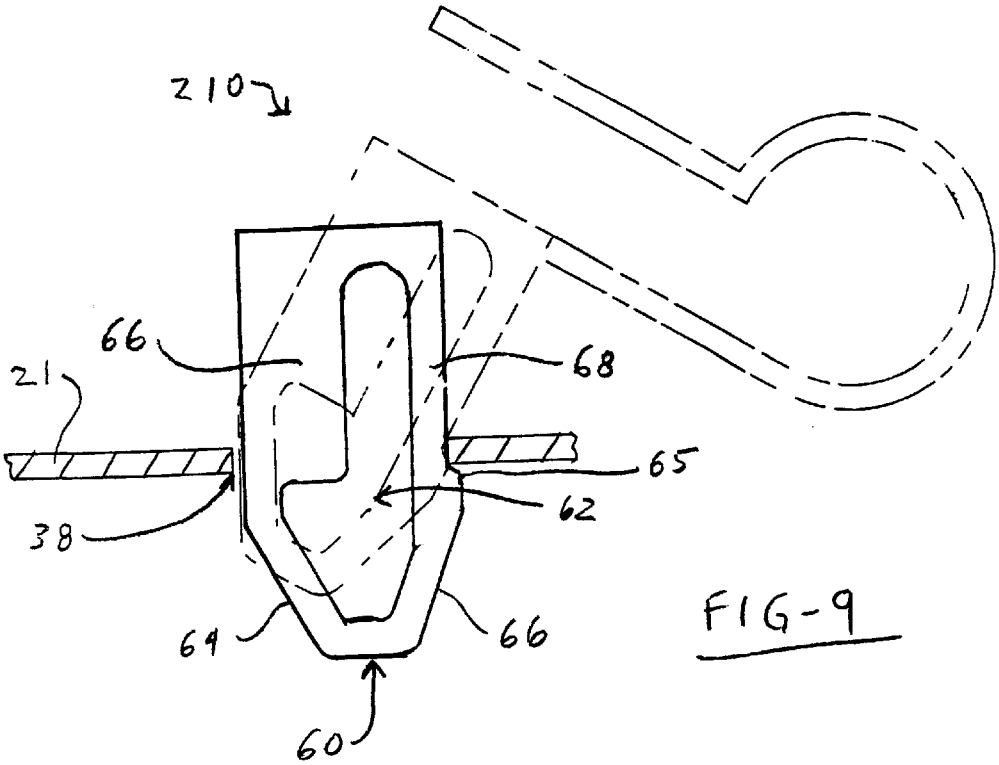
FIG. 9 illustrates a third embodiment of the retainer prongs.

FIG. 9 depicts a terminal 210 having another possible variation of means for retaining the terminal in connection with mounting member 21. Terminal 210 has a single retaining prong 60 with a central cutout 62. Single prong 60 is stronger than two smaller prongs and is therefore less likely to bend or break inadvertently prior to use. Angled surfaces 64,66 are formed on both lower corners of prong 60, and a lobe 65 projects outwardly from one edge. Cutout 62 is shaped to leave a relatively wide wall 66 on one side of prong 60 and a relatively thin wall 68 on the opposite side. Terminal 210 is placed in engagement with slot 38 by tipping it (as shown in phantom lines in FIG. 9) so that lobe 65 is hooked under mounting member 21, then rocking it back upright to slide prong 60 fully through slot 38. This results in a very low insertion force being required. If desired, terminal 210 may also be urged straight downwardly without tipping, thus requiring greater insertion force than when using the tipping method. Wall 66 is wider than wall 68 so that it has sufficient strength to resist the force to which it is subjected when the bolt is driven into engagement with mounting member 21, as described above in relation to the FIG. 8 embodiment of the invention.

While the invention has been described in connection with what are presently considered to be the most practical and preferred embodiments, it is to be understood that the invention is not to be limited to the disclosed embodiments but rather is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. An electrical terminal for providing electrical continuity between a conductor and a mounting member, the terminal comprising:

a first eyelet having a first aperture for receiving a bolt and means for holding the bolt captive within the first aperture;

a second eyelet having a second aperture;

a spacing member connecting the first eyelet with the second eyelet and maintaining the eyelets in a spaced apart relationship with the first eyelet over the second eyelet and the respective apertures in coaxial alignment, the spacing member being deformable to allow the first and second eyelets to be urged toward one another;

a retainer extending from the second eyelet and adapted to engage the mounting member to position the second eyelet against the mounting member with the eyelets aligned with a bolt-receiving hole in the mounting member, the spacing member spacing the first and second eyelets apart by a set distance such that when the bolt is captive in the first eyelet and the retainer is engaged with the mounting member, the bolt is maintained in a pre-set position wherein a distal end of a threaded section of the bolt is on the verge of engagement with a female threaded portion of the mounting member, wherein the retainer when engaged with the mounting member prevents rotation about the bolt of the terminal relative to the mounting member; and means on the first eyelet or the second eyelet for connecting the conductor to the terminal.

2. The terminal according to claim 1 wherein the spacing member comprises a curved section connecting the first eyelet with the second eyelet and having a radius of curvature greater than one half of a distance between the first and second eyelets.

3. The terminal according to claim 1 wherein the retainer comprises a single prong having the distal end flaring outwardly from one side of the prong for extending beyond an edge of a retainer-receiving hole to retain the terminal in connection with the mounting member.

4. The terminal according to claim 3 wherein the single prong has a cutout shape to define a narrow wall on a first side of the prong, the distal end flaring outwardly from the first side on the prong and a wider wall on an opposite second side of the prong.

5. The terminal according to claim 1 wherein the means for connecting the conductor to the terminal comprises a stem extending from the first or second eyelet, wherein the stem includes at least one crimping tab.

6. The terminal according to claim 1 wherein the means for holding the bolt captive comprises a plurality of tabs disposed around a circumference of the first aperture and projecting radially inward to engage the bolt.

7. An electrical terminal for providing electrical continuity between a conductor and amounting member having a thickness, the terminal comprising:

a first eyelet having a first aperture for receiving a bolt and means for holding the bolt captive within the first aperture;

a second eyelet having a second aperture;

a spacing member connecting the first eyelet with the second eyelet and maintaining the eyelets in a spaced apart relationship with the respective apertures in coaxial alignment, the spacing member being deformable to allow the first and second eyelets to be urged toward one another;

a retainer extending from the second eyelet and adapted to engage the mounting member to position the second eyelet adjacent the mounting member with the eyelets aligned with a bolt-receiving hole in the mounting member, the retainer comprising first and second spaced apart prongs deflectable toward one another as the retainer is urged through a retainer-receiving hole, the first prong having a length greater than the thickness of the mounting member and an outwardly flared distal end for extending beyond an edge of the retainer-receiving hole to retain the terminal in connection with the mounting member, the second prong being wider than the first prong to provide greater rigidity to the second prong; and means on the first eyelet or the second eyelet for connecting the conductor to the terminal.

8. An electrical terminal for providing electrical continuity between a conductor and a mounting member having first and second holes formed therein, the terminal comprising:

a first eyelet having a first aperture;

a second eyelet having a second aperture;

a spacing member connected at a first end with the first eyelet and at a second end with the second eyelet, the spacing member maintaining the eyelets in a spaced apart relationship with the respective apertures in coaxial alignment, the spacing member being deformable to allow the first and second eyelets to be urged toward one another;

a bolt having a head and a shank, the first eyelet having means adjacent the first aperture for holding the bolt captive in the first eyelet such that the head is adjacent a surface of the first eyelet opposite from the second eyelet and the shank passes through the first and second apertures to extend from the second eyelet, the bolt being rotatable with respect to both eyelets;

a retainer extending from the second eyelet in the same direction as the bolt shank, the retainer engagable with the first hole to position the second eyelet adjacent the mounting member with the shank aligned with the second hole, wherein the retainer when engaged in the first hole of the mounting member prevents rotation of the terminal about the bolt relative to the mounting member; and means on the first eyelet or the second eyelet for connecting the conductor to the terminal.

9. The terminal according to claim 8 wherein the shank has a threaded section having a length and the first and second eyelets are spaced apart by a distance related to the threaded section length such that when the terminal is engaged with the mounting member, the bolt is maintained in a pre-set position wherein a distal end of the threaded section is disposed proximate a female threaded portion of the mounting member.

10. The terminal according to claim 8 wherein the spacing member comprises a curved section connecting the eyelets and having a radius of curvature greater than one half of a distance between the first and second eyelets.

11. The terminal according to claim 8 wherein the retainer comprises first and second spaced apart prongs deflectable toward one another as the retainer is urged through the first hole, at least one of the prongs having an outwardly flared distal end for extending beyond an edge of the first hole to retain the terminal in connection with the mounting member.

12. The terminal according to claim 8 wherein the bolt is held captive in the first eyelet by a plurality of tabs disposed around a circumference of the first aperture and projecting radially inward to engage the bolt.

13. An electrical terminal for providing electrical continuity between a conductor and a mounting member, the terminal comprising:

means for connecting the conductor to the terminal;

means for holding a bolt in rotatable connection with the terminal; and a retainer adapted to engage a hole in the mounting member, the retainer comprising first and second spaced apart prongs deflectable toward one another as the retainer is urged through the hole, the first prong having an outwardly flared distal end for extending beyond an edge of the hole to retain the terminal in connection with the mounting member, the second prong being wider than the first prong, wherein the retainer when engaged with the mounting member prevents rotation of the terminal about the bolt relative to the mounting member.

14. The terminal according to claim 13 further comprising means for positioning the bolt in a pre-set position relative to the mounting member wherein a threaded shank of the bolt is on the verge of engagement with a female threaded portion of the mounting member, the positioning means being deformable to allow the bolt to be driven into engagement with the female threaded portion.

15. The terminal according to claim 14 wherein the means for holding the bolt comprises a first eyelet having a first aperture for receiving the bolt and a plurality of tabs disposed around a circumference of the first aperture and projecting radially inward to engage the bolt.

16. The terminal according to claim 15 wherein the means for positioning the bolt in a pre-set position relative to the mounting member comprises:

a second eyelet having a second aperture; and a spacing member connecting the first eyelet with the second eyelet and maintaining the eyelets in a spaced apart relationship with the respective apertures in coaxial alignment, the spacing member being deformable to allow the first and second eyelets to be urged toward one another.

17. An electrical terminal for providing electrical continuity between a conductor and a mounting member, the terminal comprising:

means for connecting the conductor to the terminal;

means for holding a bolt in rotatable connection with the terminal; and a retainer for engaging the mounting member, the retainer comprising a single prong having the distal end of the prong flaring outwardly from a first side of the prong for extending beyond an edge of a retainer-receiving hole to retain the terminal in connection with the mounting member, the single prong having a cutout shaped to define a narrow wall on the first side of the prong, and a relatively wider wall on an opposite second side of the prong.

* * * * *